US009903120B2

(12) United States Patent
Naujoks

(10) Patent No.: US 9,903,120 B2
(45) Date of Patent: Feb. 27, 2018

(54) INSULATED CONCRETE LEDGE FORM REINFORCEMENT MEMBER

(71) Applicant: Richard Naujoks, Winnipeg (CA)

(72) Inventor: Richard Naujoks, Winnipeg (CA)

( * ) Notice: Subject to any disclaimer, the term of this patent is extended or adjusted under 35 U.S.C. 154(b) by 0 days.

(21) Appl. No.: 15/283,556

(22) Filed: Oct. 3, 2016

(65) Prior Publication Data

US 2017/0130457 A1 May 11, 2017

Related U.S. Application Data

(60) Provisional application No. 62/251,995, filed on Nov. 6, 2015.

(51) Int. Cl.
*E04C 5/16* (2006.01)

(52) U.S. Cl.
CPC ..... *E04C 5/163* (2013.01)

(58) Field of Classification Search
CPC ..... E04C 5/163; E04C 5/167; E04C 5/168; E04C 5/18
USPC ..... 52/685–686, 688, 503, 505, 426
See application file for complete search history.

(56) References Cited

U.S. PATENT DOCUMENTS 2,034,766 A * 3/1936 Navarre ..... E04B 2/00 52/274
2,078,069 A * 4/1937 Eliel ..... E04B 2/00 52/169.1
2,298,837 A * 10/1942 Oswald ..... E02D 27/02 249/155
4,524,553 A * 6/1985 Hacker ..... E02D 31/00 52/169.11
4,663,908 A * 5/1987 Kestel, Jr. ..... E02D 31/00 52/274
5,174,083 A * 12/1992 Mussell ..... E02D 27/02 249/5
5,337,533 A * 8/1994 Kajita ..... E04B 1/0007 52/169.14
5,371,990 A * 12/1994 SalahUddin ..... E04B 1/163 52/379
5,826,395 A * 10/1998 Weaver ..... E04B 2/14 52/105
5,839,243 A * 11/1998 Martin ..... E04B 2/8629 52/302.4
6,041,561 A * 3/2000 LeBlang ..... E04B 1/14 52/234

(Continued)

*Primary Examiner* — Brent W Herring
(74) *Attorney, Agent, or Firm* — Ryan W. Dupuis; Ade & Company Inc.; Kyle R. Satterthwaite

(57) ABSTRACT

A reinforcement member is used with an insulated concrete ledge form including a straight inner form wall, a sloped outer form wall defining a longitudinal slot for receiving an elongate rebar member parallel to the inner form wall, and a plurality of form ties connected between the inner and outer form walls across a main concrete receiving cavity, in which each form tie defines at least one rebar chair for connection to a rebar member. The reinforcement member has i) a bridge portion to extend laterlly from an inner end to an outer end, ii) a hook portion depending from the outer end of the bridge portion so as to extend over and hook onto the elongate rebar member; and iii) a seat portion depending from the inner end of the bridge portion for mating connection with a respective rebar chair of a respective one of the form ties.

20 Claims, 5 Drawing Sheets

(56) References Cited

U.S. PATENT DOCUMENTS

| | | | | |
|---|---|---|---|---|
| 6,314,697 | B1 * | 11/2001 | Moore, Jr. | E04B 2/8635 52/426 |
| 6,318,040 | B1 | 11/2001 | Moore, Jr. | |
| 6,336,301 | B1 * | 1/2002 | Moore, Jr. | E04B 2/8635 52/426 |
| 6,647,686 | B2 * | 11/2003 | Dunn | E04B 2/8641 52/309.17 |
| 6,935,081 | B2 * | 8/2005 | Dunn | E04B 2/8641 249/191 |
| 7,243,897 | B2 * | 7/2007 | Huber | E02D 27/01 249/216 |
| 7,437,858 | B2 | 10/2008 | Pfeiffer et al. | |
| 7,966,784 | B2 * | 6/2011 | Wobber | E04B 1/4178 52/410 |
| 8,844,224 | B2 * | 9/2014 | Lindquist | E04C 5/16 52/294 |
| 8,887,465 | B2 * | 11/2014 | Crosby | E04B 2/8635 52/379 |
| 2002/0124508 | A1 * | 9/2002 | Dunn | E04B 2/8641 52/426 |
| 2005/0155306 | A1 * | 7/2005 | Childres | E04B 2/8617 52/426 |
| 2006/0059804 | A1 * | 3/2006 | Brown | E04C 5/0604 52/223.13 |
| 2007/0062138 | A1 * | 3/2007 | Wobber | E04B 1/4178 52/379 |
| 2009/0133351 | A1 * | 5/2009 | Wobber | E04B 1/4178 52/565 |
| 2013/0283724 | A1 * | 10/2013 | Lindquist | E04C 5/16 52/677 |

* cited by examiner

INSULATED CONCRETE LEDGE FORM REINFORCEMENT MEMBER

This application claims the benefit under 35 U.S.C. 119(e) of U.S. provisional application Ser. No. 62/251,995, filed Nov. 6, 2015.

FIELD OF THE INVENTION

The present invention relates to a reinforcement member for use in an insulated concrete ledge form comprising a straight form wall and a sloped form wall joined by form ties, and more particularly the present invention relates to a reinforcement member which is arranged to be connected between rebar chairs in the form ties and a rebar member in a rebar chair of the sloped form wall.

BACKGROUND

A known wall construction method comprises the use of insulated concrete forms into which concrete is poured and set. Typical insulated concrete forms comprise blocks which are abutted end to end in rows stacked on upon the other to form a vertical wall. Each block typically comprises an inner insulated wall portion and an outer insulated wall portion which are supported parallel and spaced apart from one another by webs connected therebetween. A typical material of the wall portions is polystyrene or any other similarly rigid and insulating material. When the blocks are stacked with one another the insulated wall portions at the inner and outer sides form continuous insulated walls with a cavity therebetween into which the concrete is arranged to be received.

Often it is desirable to support a veneer wall along an outer side of the main load bearing wall formed by insulated concrete forms. The veneer wall is typically supported by forming a concrete ledge at the base of the veneer wall which is often located at ground level. The concrete ledge is integral with the concrete within the cavity of the insulated concrete forms by providing an insulated concrete ledge form at the location of the concrete ledge.

One example of an insulated concrete ledge form is disclosed in U.S. Pat. No. 7,437,858 in which the form comprises a row of blocks stacked in series with the straight wall forms above and below the ledge. Each of the blocks in the insulated concrete ledge form row comprises an inner straight form wall and an outer sloped form wall with the inner and outer form walls being supported spaced apart from one another by a main concrete receiving cavity using form ties joined between the form walls similarly to the forms stacked above and below the ledge form. Typically spaced apart partitions extend inwardly from the sloped form wall at spaced apart positions corresponding to the locations of the form ties. The partitions define a plurality of spaced apart corbel cavities therebetween into which concrete corbels are formed. A longitudinal slot in the top of the partitions on the sloped form wall define a longitudinally extending rebar chair for receiving an elongate reinforcement rebar member therein. The form ties also include rebar chairs formed therein to support additional reinforcement rebar members therein.

U.S. Pat. No. 7,437,858 by Pfeiffer et al proposes replacing the rebar in the rebar chairs with an already assembled ladder-like structure comprising an inner and outer longitudinal rail received in the rebar chairs of the sloped form wall and the form ties respectively. A plurality of connecting arms align with the corbel cavities for connection between the inner and outer rails. Use of the reinforcement members as described requires preassembling a large awkward component which subsequently requires specific placement within the forms. The large structure is awkward to store, transport and place in the forms due to the preassembled configuration thereof.

Prior to U.S. Pat. No. 7,437,858 insulated concrete ledge forms have been known to be reinforced by locating rebar in both the rebar chair of the sloped form wall and in the form ties with the two rebar members being connected by hook shaped rebar which requires careful alignment and hooked connection with both rebar members when installed. An example of a hook shaped rebar member is illustrated in U.S. Pat. No. 6,318,040 by Moore Jr. In particular a hook shaped rebar form is designated by reference character 290 in FIG. 8. Placement of the hook shaped rebar requires time consuming individual placement, alignment, and typically some bending to effectively hook the rebar onto both longitudinally extending rebar members in the rebar chairs of the sloped form wall and the form ties.

SUMMARY OF THE INVENTION

According to one aspect of the invention there is provided a reinforcement member for an insulated concrete ledge form including a substantially straight inner form wall, a sloped outer form wall defining a longitudinal slot for receiving an elongate rebar member therein which extends in a longitudinal direction parallel to the inner form wall, and a plurality of form ties connected between the inner form wall and the outer form wall such that the inner and outer form walls are spaced apart in a lateral direction by a main concrete receiving cavity therebetween, each form tie defining at least one rebar chair for connection to a rebar member, the reinforcement member comprising:

a bridge portion arranged to extend generally in the lateral direction from an inner end to an outer end;

a hook portion depending from the outer end of the bridge portion so as to be arranged to extend over and hook onto the elongate rebar member in the longitudinal slot of the sloped outer form wall; and a seat portion depending from the inner end of the bridge portion so as to be arranged for mating connection with a respective rebar chair of a respective one of the form ties.

According to a second aspect of the present invention there is provided a concrete ledge construction comprising:

an insulated concrete ledge form comprising:

a substantially straight inner form wall;

a sloped outer form wall defining a longitudinal slot extending in a longitudinal direction parallel to the inner form wall; and a plurality of form ties connected between the inner form wall and the outer form wall such that the inner and outer form walls are spaced apart in a lateral direction by a main concrete receiving cavity therebetween;

each form tie defining at least one rebar chair arranged for connection to a rebar member;

an elongate rebar member received in the longitudinal slot of the sloped outer form wall; and a reinforcement member comprising:

a bridge portion extending generally in the lateral direction from an inner end in the main concrete receiving cavity to an outer end adjacent the elongate rebar member;

a hook portion depending from the outer end of the bridge portion so as to extend over and hook onto the elongate rebar member in the longitudinal slot of the sloped outer form wall; and a seat portion depending from the inner end of the bridge portion in mating connection with a respective rebar chair of a respective one of the form ties.

By providing a ledge reinforcement member which includes a hook on only one end with a suitable seat portion on the opposing end which mates directly with the rebar chair of a respective one of the form ties, the reinforcement member can be readily placed into a form without bending or alignment being required. The member is first hooked onto the rebar in the longitudinal slot of the sloped outer form wall followed by simply dropping the seat portion into mating connection with the respective rebar chair of the form tie. The seat portion permits a quick self alignment of the reinforcement member relative to the form tie which in turn automatically aligns the hook and bridge portion of the reinforcement member in the longitudinal direction relative to respective corbel cavities. When providing two hook members spaced apart on opposite sides of a single seat portion, the reinforcement member can be readily hooked into place and centrally aligned within two adjacent corbel cavities with a single placement and alignment of the seat portion relative to one of the form ties. Furthermore, the reinforcement member is relatively small and simple in construction so as to minimize cost and difficulty associated with manufacturing, transport and storage prior to installation in a concrete ledge form.

Preferably the reinforcement member is used in combination with an insulated concrete ledge form including partitions formed on an inner surface of the sloped outer form wall defining corbel cavities between adjacent ones of the partitions which are open to the main concrete receiving cavity into which the bridge portion and the hook portion are arranged to be received.

The bridge portion may comprise at least one rail extending in the lateral direction which is offset in the longitudinal direction from the seat portion such that said at least one rail is arranged for alignment with a respective one of the corbel cavities when the seat portion is mated with the respective rebar chair of the respective one of the form ties.

The rails are preferably arranged to be centered in the longitudinal direction relative to the respective one of the corbel cavities.

The rail preferably extend substantially horizontally so as to be connected at the inner end to a leg which depends downwardly from the rail to a bottom end connected to the seat portion which is spaced below the hook portion.

The bridge portion preferably comprises two rails extending in the lateral direction parallel and spaced apart from one another in the longitudinal direction on opposing sides of seat portion for alignment with respective ones of the corbel cavities.

The hook portion in this instance preferably comprises a hook member extending downwardly from each rail so as to be arranged to hook onto the elongate rebar member at spaced apart locations in the longitudinal direction.

The hook portion may extend downwardly from the bridge portion at an inclination extending inwardly towards the seat portion.

The seat portion preferably comprises two arms joined at respective top ends at an apex of the seat portion arranged for mating connection with the respective rebar chair in which the arms extend downwardly and away from one another to respective bottom ends which are spaced apart from one another.

The two arms may lie in a common vertical plane lying parallel to the longitudinal direction.

The seat portion preferably includes a vertical slot formed at the apex of the seat portion having a downwardly facing opening arranged to slidably receive the respective form tie therein.

A width of the slot in the longitudinal direction is preferably approximately equal to a width of the form tie in the longitudinal direction.

The bridge portion, the hook portion, and the seat portion may comprise a single bent wire which is integral, continuous, and seamless between opposing ends thereof.

In the illustrated embodiment, the bridge portion comprises two rails extending generally in the lateral direction spaced apart from one another in the longitudinal direction on opposing sides of seat portion, the hook portion comprises a hook member extending downwardly from the outer end of each rail so as to be arranged to hook onto the elongate rebar member at spaced apart locations in the longitudinal direction, and the seat portion is connected between the inner ends of the two rails.

More particularly, the seat portion of the illustrated embodiment comprises two arms joined at respective bottom ends to respective ones of the inner ends of the rails and extending upwardly and inwardly towards respective top ends where the two arms are joined at an apex of the seat portion arranged for mating connection with the respective rebar chair.

When each rail includes a leg depending downwardly from the inner end thereof to a bottom end which is connected to the bottom end of a respective one of the arms of the seat portion, preferably the legs and the arms of the seat portion lie in a substantially common plane oriented in the longitudinal direction.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
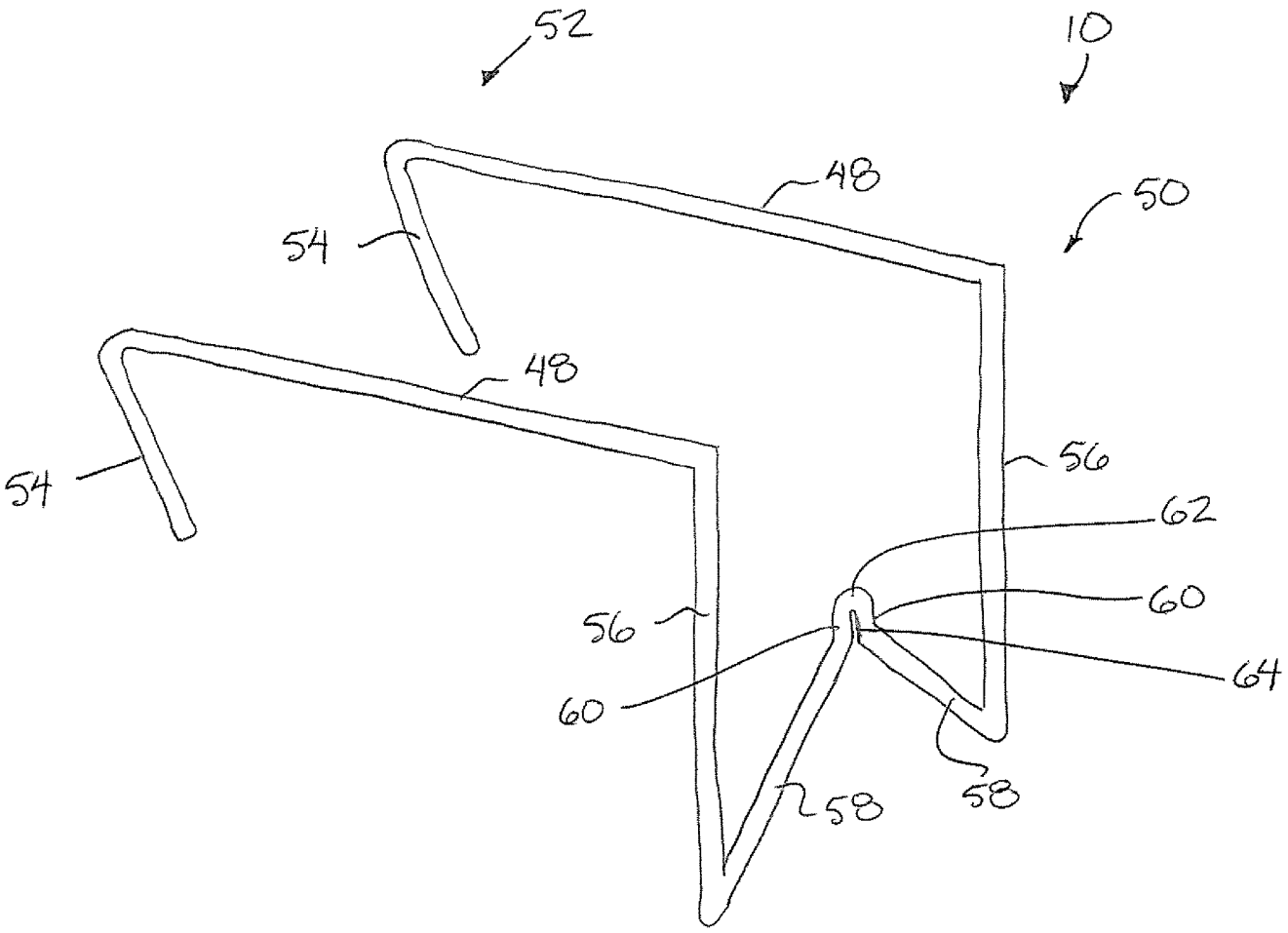
FIG. 1 is a perspective view of the reinforcement member for an insulated concrete ledge form.
Figure 2:
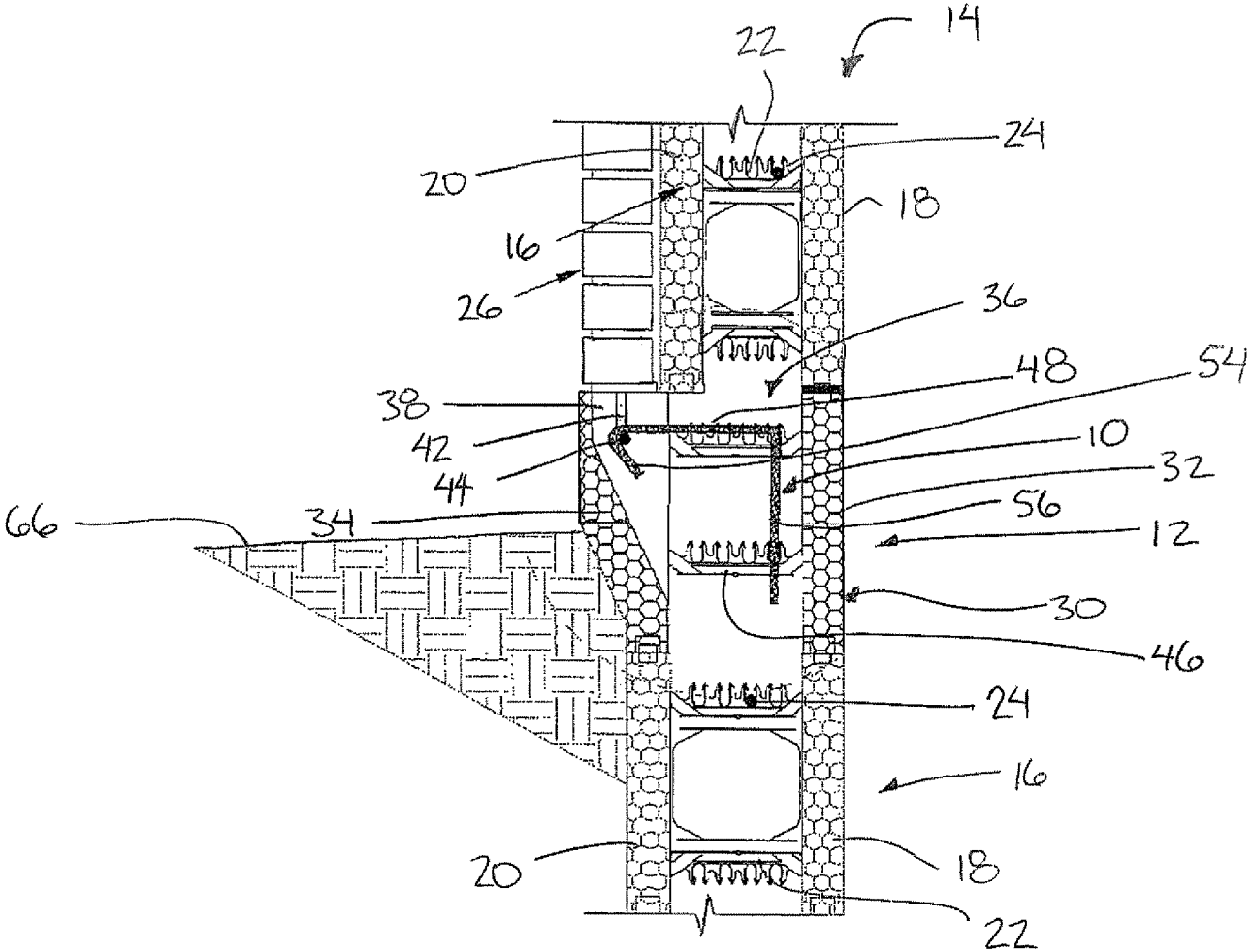
FIG. 2 is a partly sectional side elevational view of the reinforcement member installed in an insulated concrete ledge form.
Figure 3:
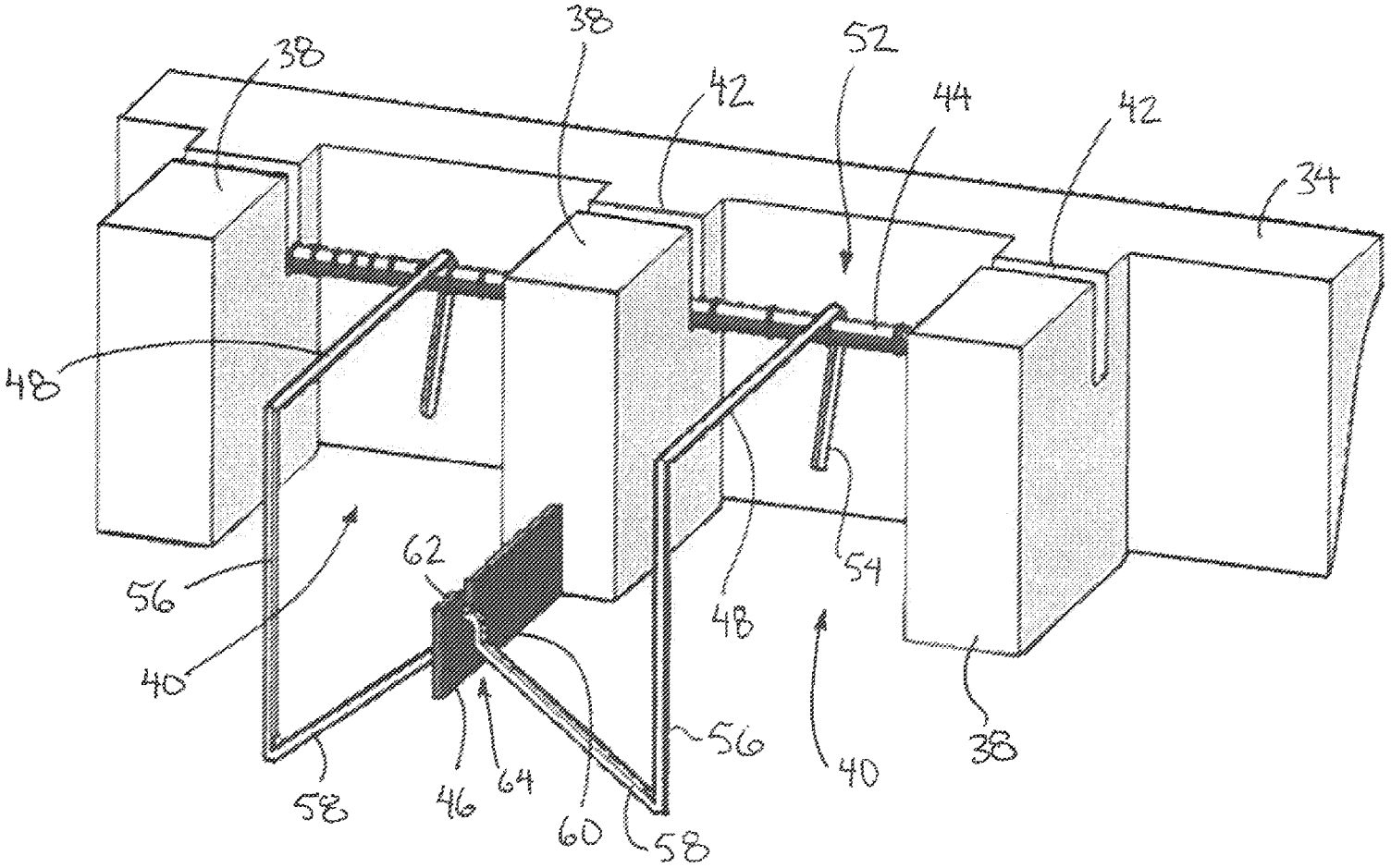
FIG. 3 is a perspective view of the reinforcement member relative to a portion of the insulated concrete ledge form.
Figure 4:
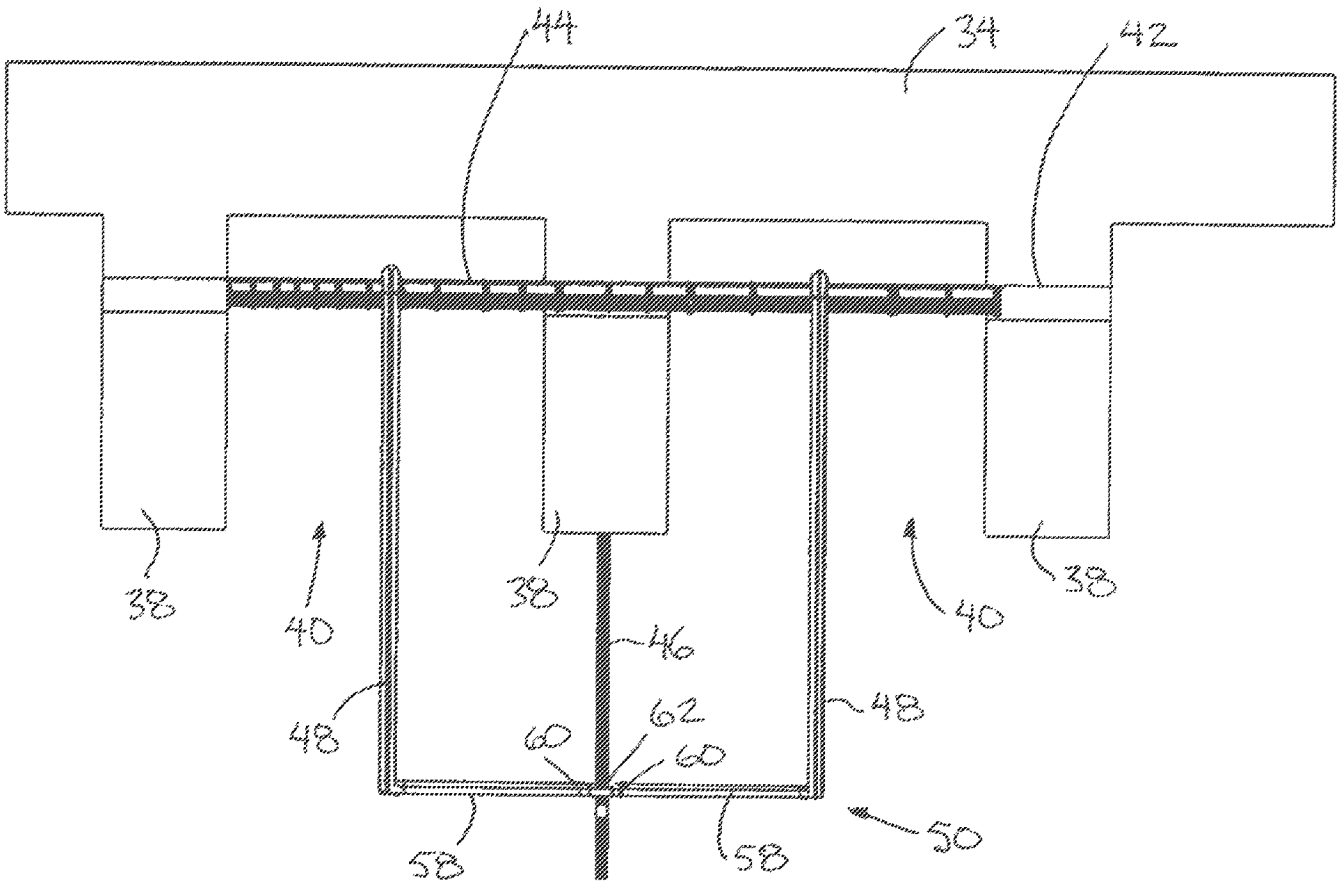
FIG. 4 is a top plan view of the reinforcement member according to FIG. 3.
Figure 5:
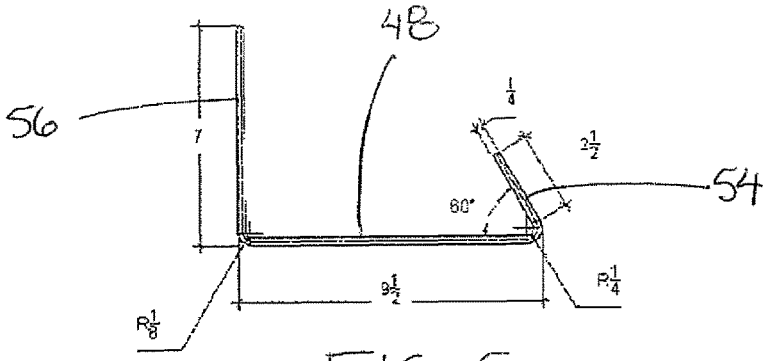
FIG. 5 is a side elevational view of the reinforcement member.
Figure 6:
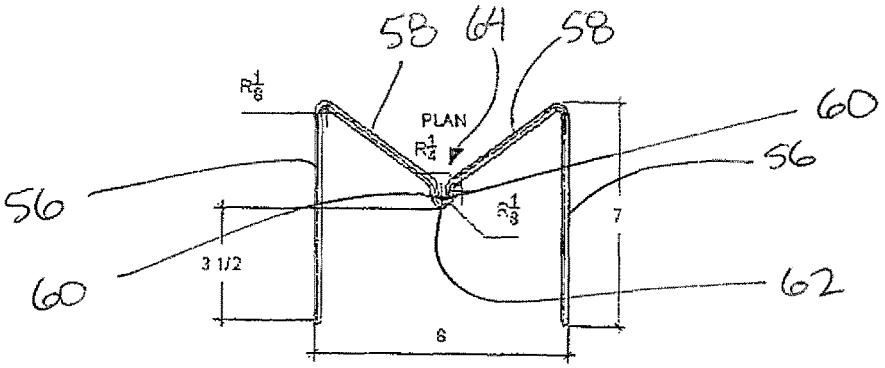
FIG. 6 is an end elevational view of the reinforcement member.
Figure 7:
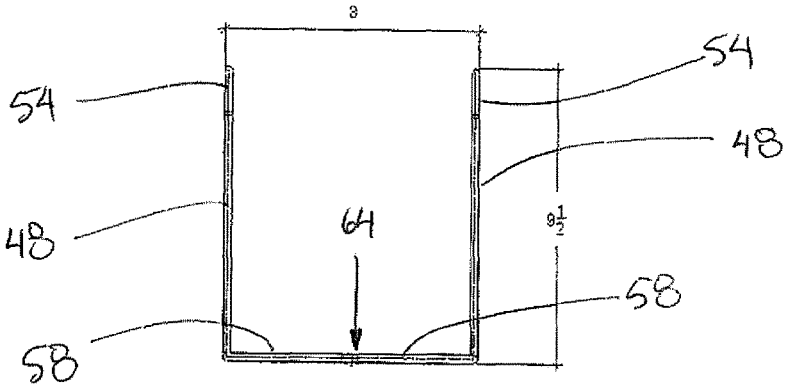
FIG. 7 is a top plan view of the reinforcement member.

Referring to the accompanying figures, there is illustrated an insulated concrete ledge form reinforcement member generally indicated by reference numeral 10. The reinforcement member 10 is suited for use in reinforcing a concrete brick ledge formed using an insulated concrete ledge form.

The ledge form 12 typically comprises one component of an overall insulated concrete form wall construction 14.

The insulated concrete forms typically comprise blocks 16 abutted in an end to end configuration in rows which are stacked one upon the other to form a vertical wall. Each of the blocks is typically formed with a suitable interlocking connection for alignment and joining to adjacent blocks formed in the wall. More particularly, each block 16 has an inner insulated wall portion 18 and an outer insulated wall portion 20 which are supported parallel and spaced apart by rigid webs 22, also known as form ties, to define a main concrete receiving cavity therebetween. The webs 22 which may be formed of plastic or other moulded material typically include suitable receptacles, commonly known as rebar chairs, for retaining rebar 24 spanning parallel to the wall portions along the length of the wall to interconnect plural webs 22. Once the blocks are stacked to form the shape of the wall, the cavities of the blocks are filled with concrete. This may be accomplished in stages for example in sections of four feet in elevation.

When mounting a veneer wall on the outer side of the insulated concrete wall, the concrete ledge is typically formed at ground level at the base of the veneer wall 26 using the insulated concrete ledge form 12.

Similarly to the blocks 16, the insulated concrete ledge form is also formed of a plurality of blocks 30 abutted end to end in a common row stacked with the other blocks 16 forming the remainder of the concrete wall above and below. Each of the blocks 30 of the ledge form includes a straight inner form wall 32 arranged to be supported to be continuous and in a common plane with the inner wall portions 18 of the other blocks 16 above and below.

The blocks 30 of the ledge form further comprise a sloped outer form wall 34 having a bottom end which is spaced outwardly from the straight inner form wall 32 in a lateral direction by the width of the main concrete receiving cavity 36 between the form walls. The width of the cavity 36 corresponds approximately to the width of the cavity of the blocks 16 below the concrete ledge so that the bottom of the sloped wall is aligned with the outer wall portion 20 of the blocks therebelow. The sloped outer form wall 34 extends upwardly at an outward incline away from the inner form wall to a top end which is spaced outwardly from the main cavity 36 by a lateral distance corresponding to the lateral width of the concrete ledge to be formed.

The outer form wall 34 includes an inner surface having a plurality of partitions 38 integrally formed thereon in which each partition generally comprises a protrusion forming a vertical wall perpendicular to the longitudinal direction of the wall so that the sloped outer form wall 34 defines a plurality of corbel cavities 40 with each cavity being defined between an adjacent pair of the partitions. Each partition spans the full height of the form but extends only partway towards the inner wall so that the corbel cavities are open at the inner side to the main cavity forming a common space for receiving concrete therein. The inner end of each partition is generally in vertical alignment with the inner surface of the outer wall portions 20 of the blocks 16 therebelow.

Each partition includes a recess formed in the top end thereof so that the plurality of recesses are aligned with one another to form a common longitudinal slot 42 extending in the longitudinal direction of the wall and open to the top end of the ledge form. The slot 42 is thus suited for receiving an elongate rebar member 44 extending therethrough in the longitudinal direction.

The ledge form blocks 30 further comprise form ties 46 which connect between each partition 38 of the sloped form wall and the straight inner form wall so that the form ties span in the lateral direction across the main cavity 36 to support the form walls relative to one another and maintain the space therebetween in the lateral direction.

The reinforcement member 10 comprises two rails 48 which span horizontally in the lateral direction between an inner end 50 and an outer end 52. The two rails are parallel and spaced apart from one another in the longitudinal direction of the wall by a distance corresponding to the center to centre distance between two adjacent corbel cavities of the ledge form. The inner ends 50 of the rails 48 extend partway into the main cavity so as to terminate nearer to the inner form wall than the sloped outer wall. The outer end 52 is arranged to be positioned adjacent the rebar 44 in the longitudinal slot 42 of the sloped form wall. The two rails 48 serve to define a bridge portion of the reinforcement member which extends between the inner and outer ends thereof.

At the outer end, the reinforcement member includes two hook members 54. Each hook member extends downward from a respective one of the rails 48 at the outer end thereof so that the hook member extends downward at an inward inclination towards the opposing inner end of the reinforcement member. Each hook member is joined to the respective rail at an acute interior angle so as to be suitable for extending over and hooking onto the rebar 44. The rebar 44 is thus received within the apex defined by the connection of each hook member to the respective rail. The two hook members 54 thus serve to hook onto the rebar at spaced apart positions in the longitudinal direction of the wall with each hook member being centered in the longitudinal direction within a respective corbel cavity of an adjacent pair of the cavities.

At the opposing inner end, two legs 56 are provided in which each leg 56 extends vertically downward from the inner end of a respective one of the rails 48. The legs 56 are longer than the hook members so that the bottom end of each leg is spaced below the rebar and the hook members hooked thereon in use.

Two arms 58 are provided in which each arm is connected at a bottom end to the bottom end of the respective one of the legs 56. The two arms extend upward and inwardly towards one another for being joined at respective top ends at an apex. The two arms 58 and the two legs 56 lie in a common vertical plane which is substantially parallel to the straight inner wall in use.

The top end of each arm includes a vertical end portion 60 joined at an upper connecting portion 62 for connecting the top ends of the two arms together. The vertical end portion 60 and the connecting portion 62 therebetween define a downward facing vertical slot 64 between the end portions 60 at the apex of the two arms which defines a seat portion of the reinforcement member. The seat portion is suitably arranged to be lowered onto a respective form tie such that the form tie is slidably received up into the vertical slot and the connecting portion 62 fits downwardly into an upward facing rebar chair of the form tie in a mating connection therewith. The width of the slot in the longitudinal direction corresponds to the width of the form tie so as to provide a close fitting tolerance therebetween. The two arms 58 which extend upwardly and inwardly towards the vertical slot 64 act as a mouth or guide to the slot for centering the form tie up inwardly into the vertical slot as the two arms of the seat portion of the reinforcement member are lowered onto the form tie.

The apex of the two arms is arranged to be centered in the longitudinal direction between the two hook members. In this matter, the two hook members 54 which define a hook portion of the reinforcement member are first hooked onto the rebar 44 at locations within a respective pair of adjacent corbel cavities. Subsequently lowering the seat portion of the reinforcement member onto a respective one of the form ties causes the form tie to be guided by the inward sloping arms 58 for automatically centering the seat portion relative to the form tie which in turn automatically centers the two hook members within the respective adjacent corbel cavities. The arms 58 are shorter than the legs 56 so as to be connected with one another at a location spaced below the elevation of the two rails and the hook members so that the seat portion is mated with the rebar chair of a form tie which is spaced below the longitudinal slot in the sloped form wall.

The reinforcement member is formed of a single, continuous, seamless and integral wire which has been bent to form the desired shape of the reinforcement member. In particular, the two portions 60 defining the vertical slot of the seat portion forms the centre of the bent wire which is connected through the arms 58, the legs 56 and the rails 48 to respective ones of the hook members 54 forming the opposing ends of the continuous wire.

In use, a foundation wall is typically first formed below grade using blocks 16 of the insulated concrete form. At ground level a row of blocks 30 are abutted end to end to form a continuous row defining the insulated concrete ledge form. Rebar is first placed in the longitudinal slot 42 of the ledge form. Subsequently one reinforcement member 10 is associated with each adjacent pair of corbel cavities with the hook members and associated rails of the bridge portion being received and centered within respective ones of the corbel cavities by lowering the seat portion onto the respective form tie between the inner and outer form walls. Alignment of the seat portion into mating connection with a respective rebar chair on the form tie automatically centres the hook members within the respective corbel cavities in the longitudinal direction. Sufficient reinforcement members are provided along the length of the ledge form such that one hook member and associated rail 48 is located within each corbel cavity. Additional blocks corresponding to an upper portion of the wall are then stacked above the ledge form against which the veneer wall spans when supported on the resulting ledge. Pouring of the concrete into the main cavity sets the reinforcement members into the concrete. The location of the vertical legs 56 in the main cavity with the seat portion on the form tie provides sufficient anchoring against lateral loads applied through the bridge portion to adequately support the rebar in the longitudinal slot of the sloped outer wall to reinforce the ledge relative to the remainder of the concrete wall. In particular, each hook member provides support to a respective corbel formed by a respective one of the corbel cavities so that the resulting corbel projects horizontally outward from the remainder of the concrete wall being formed. The flat top surface of the longitudinally spaced apart corbels defines the horizontal ledge upon which the veneer wall is then supported.

Since various modifications can be made in my invention as herein above described, and many apparently widely different embodiments of same made, it is intended that all matter contained in the accompanying specification shall be interpreted as illustrative only and not in a limiting sense.

The invention claimed is:

1. A reinforcement member for an insulated concrete ledge form including a substantially straight inner form wall, a sloped outer form wall defining a longitudinal slot for receiving an elongate rebar member therein which extends in a longitudinal direction parallel to the inner form wall, and a plurality of form ties connected between the inner form wall and the outer form wall such that the inner and outer form walls are spaced apart in a lateral direction by a main concrete receiving cavity therebetween, each form tie defining at least one rebar chair for connection to a rebar member, the reinforcement member comprising:

a bridge portion arranged to extend generally in the lateral direction from an inner end to an outer end;

a hook portion depending from the outer end of the bridge portion so as to be arranged to extend over and hook onto the elongate rebar member in the longitudinal slot of the sloped outer form wall; and a seat portion depending from the inner end of the bridge portion so as to be arranged for mating connection with a respective rebar chair of a respective one of the form ties;

wherein the seat portion comprises two arms joined at respective top ends at an apex of the seat portion arranged for mating connection with the respective rebar chair, the arms extending downwardly and away from one another to respective bottom ends which are spaced apart from one another.

2. The member according to claim 1 in combination with an insulated concrete ledge form including partitions formed on an inner surface of the sloped outer form wall defining corbel cavities between adjacent ones of the partitions which are open to the main concrete receiving cavity into which the bridge portion and the hook portion are arranged to be received.

3. The member according to claim 2 wherein the bridge portion comprises at least one rail extending in the lateral direction which is offset in the longitudinal direction from the seat portion such that said at least one rail is arranged for alignment with a respective one of the corbel cavities when the seat portion is mated with the respective rebar chair of the respective one of the form ties.

4. The member according to claim 3 wherein said at least one rail is arranged to be centered in the longitudinal direction relative to the respective one of the corbel cavities.

5. The member according to claim 3 wherein said at least one rail extends substantially horizontally and is connected at the inner end to a leg which depends downwardly from the rail to a bottom end connected to the seat portion which is spaced below the hook portion.

6. The member according to claim 2 wherein the bridge portion comprises two rails extending in the lateral direction parallel and spaced apart from one another in the longitudinal direction on opposing sides of seat portion for alignment with respective ones of the corbel cavities.

7. The member according to claim 6 wherein the hook portion comprises a hook member extending downwardly from each rail so as to be arranged to hook onto the elongate rebar member at spaced apart locations in the longitudinal direction.

8. The member according to claim 1 wherein the hook portion extends downwardly from the bridge portion at an inclination extending inwardly towards the seat portion.

9. The member according to claim 1 wherein the two arms lie in a common vertical plane lying parallel to the longitudinal direction.

10. The member according to claim 1 wherein the seat portion includes a vertical slot formed at the apex of the seat portion having a downwardly facing opening arranged to slidably receive the respective form tie therein.

11. The member according to claim 10 wherein a width of the slot in the longitudinal direction is approximately equal to a width of the form tie in the longitudinal direction.

12. The member according to claim 1 wherein the bridge portion, the hook portion, and the seat portion comprise a single bent wire which is integral, continuous, and seamless between opposing ends thereof.

13. The member according to claim 1 wherein the bridge portion comprises two rails extending generally in the lateral direction spaced apart from one another in the longitudinal direction on opposing sides of seat portion, the hook portion comprises a hook member extending downwardly from the outer end of each rail so as to be arranged to hook onto the elongate rebar member at spaced apart locations in the longitudinal direction, and the seat portion is connected between the inner ends of the two rails.

14. A reinforcement member for an insulated concrete ledge form including a substantially straight inner form wall, a sloped outer form wall defining a longitudinal slot for receiving an elongate rebar member therein which extends in a longitudinal direction parallel to the inner form wall, and a plurality of form ties connected between the inner form wall and the outer form wall such that the inner and outer form walls are spaced apart in a lateral direction by a main concrete receiving cavity therebetween, each form tie defining at least one rebar chair for connection to a rebar member, the reinforcement member comprising:

a bridge portion arranged to extend generally in the lateral direction from an inner end to an outer end;

a hook portion depending from the outer end of the bridge portion so as to be arranged to extend over and hook onto the elongate rebar member in the longitudinal slot of the sloped outer form wall; and a seat portion depending from the inner end of the bridge portion so as to be arranged for mating connection with a respective rebar chair of a respective one of the form ties;

wherein the bridge portion comprises two rails extending generally in the lateral direction spaced apart from one another in the longitudinal direction on opposing sides of seat portion, the hook portion comprises a hook member extending downwardly from the outer end of each rail so as to be arranged to hook onto the elongate rebar member at spaced apart locations in the longitudinal direction, and the seat portion is connected between the inner ends of the two rails; and wherein the seat portion comprises two arms joined at respective bottom ends to respective ones of the inner ends of the rails and extending upwardly and inwardly towards respective top ends where the two arms are joined at an apex of the seat portion arranged for mating connection with the respective rebar chair.

15. The member according to claim 14 wherein each rail includes a leg depending downwardly from the inner end thereof to a bottom end which is connected to the bottom end of a respective one of the arms of the seat portion.

16. The member according to claim 15 wherein the legs and the arms of the seat portion lie in a substantially common plane oriented in the longitudinal direction.

17. A concrete ledge construction comprising:

an insulated concrete ledge form comprising:

a substantially straight inner form wall;

a sloped outer form wall defining a longitudinal slot extending in a longitudinal direction parallel to the inner form wall; and a plurality of form ties connected between the inner form wall and the outer form wall such that the inner and outer form walls are spaced apart in a lateral direction by a main concrete receiving cavity therebetween;

each form tie defining at least one rebar chair arranged for connection to a rebar member;

an elongate rebar member received in the longitudinal slot of the sloped outer form wall to extend in the longitudinal direction; and a reinforcement member comprising:

a bridge portion comprising two rails which are spaced apart from one another in the longitudinal direction and which extend in the lateral direction from an inner end in the main concrete receiving cavity to an outer end adjacent the elongate rebar member;

a hook portion comprising a hook member depending downwardly from the outer end of each rail of the bridge portion so as to extend over and hook onto the elongate rebar member in the longitudinal slot of the sloped outer form wall at longitudinally spaced positions along the rebar member; and a seat portion connected between the inner ends of the two rails of the bridge portion and depending from the inner ends of the rails of the bridge portion in mating connection with a respective rebar chair of a respective one of the form ties;

the seat portion being engaged upon the rebar chair of the respective one of the form ties at an intermediate location along the seat portion which is spaced inwardly in the longitudinal direction of the rebar member relative to each of the two hook members.

18. The concrete ledge construction according to claim 17 wherein the sloped outer form wall includes a plurality of partitions formed on an inner surface thereof which define corbel cavities between adjacent ones of the partitions which are open to the main concrete receiving cavity into which the bridge portion and the hook portion are arranged to be received.

19. The concrete ledge construction according to claim 18 wherein said respective one of the form ties that the seat portion is engaged upon is connected between the inner form wall and one of the partitions, and the two hook members of the reinforcement member are hooked onto the rebar member within respective ones of the corbel cavities on opposing sides of said one of the partitions.

20. The concrete ledge construction according to claim 17 wherein the seat portion includes a slot formed therein at a location which is centered in the longitudinal direction of the rebar member between the two hook members, the slot receiving said one of the form ties that the seat portion is engaged upon therein.

* * * * *